US005893774A

United States Patent [19]

Lin

[11] Patent Number: 5,893,774

[45] Date of Patent: Apr. 13, 1999

[54] LAMP SOCKET SET WITH PRESS CONNECTING CONDUCTORS

[75] Inventor: Shwu-Miin Lin, Taipei, Taiwan

[73] Assignee: Shining Blick Enterprises Co., Ltd., Taipei, Taiwan

[21] Appl. No.: 08/872,721

[22] Filed: Jun. 11, 1997

[51] Int. Cl.[6] ..... H01R 4/24

[52] U.S. Cl. ..... 439/419; 439/417

[58] Field of Search ..... 439/417, 419, 439/402, 404, 405

[56] References Cited

U.S. PATENT DOCUMENTS

| | | | |
|---|---|---|---|
| 2,724,810 | 11/1955 | Keeler et al. | 439/417 |
| 2,739,291 | 3/1956 | Frankel | 439/417 |
| 3,899,236 | 8/1975 | Santos | 439/402 |

*Primary Examiner*—Neil Abrams
*Assistant Examiner*—Barry M. L. Standig
*Attorney, Agent, or Firm*—Pro-Techtor International Services

[57] ABSTRACT

A lamp socket set including on the top a lamp bulb socket and an engaging block on the bottom of the socket; the socket has therein two contacting pieces to connect respectively the periphery of a metallic contact annulus on the tailing end of and a central end tip of the lamp bulb, and two prongs on the contacting pieces; a receiving seat is provided on the bottom end of the socket and has a receiving space defined by its two sides with inside teeth, two recesses are provided on the top of the receiving space for receiving conductors; an engaging block conforming in shape with the receiving space is provided having external teeth corresponding in position to the inside teeth, and also is provided on its top surface opposing to the top of the receiving space with other recesses for press contacting the conductors; the engaging block is pressed vertically onto the receiving seat to render the prongs to extend through the conductors and can be removed horizontally.

5 Claims, 5 Drawing Sheets

LAMP SOCKET SET WITH PRESS CONNECTING CONDUCTORS

BACKGROUND OF THE INVENTION

1. Field of the Invention

The present invention is related to a lamp socket set in which the conductors can be press connected, and especially to the lamp socket set specifically suit a decorative lamp string, the lamp socket set is provided with contacting pieces with prongs which is coordinated with an engaging block, so that the contacting pieces can directly contact the conductors.

2. Description of the Prior Art

A conventional lamp socket is provided therein with an annular contact member for contacting the metallic end of a lamp bulb and another metalic contact for contacting the end tip of the lamp bulb to thereby form a complete loop for electric current, power is turned on to lighten the lamp bulb when the lamp bulb is turned in position.

Taking the decorative lamp string as an example, a plurality of separately arrayed lamp bulbs are provided on a couple of conductors, each bulb is turned on by connecting of a lamp socket with the conductors, the metallic annular contact member and the metallic contact are connected respectively with a corresponding conductor. Conventionally, these metallic contacts are directly connected with the conductors by assembling or welding, such connecting is troublesome and inconvenient, and mass production for such structure is time wasting and thus is uneconomic.

SUMMARY OF THE INVENTION

In view of this, the object of the present invention is to provide a lamp socket set in which the conductors can be press connected, wherein, a lamp socket is provided with contacting pieces havaing prongs, and is bended down on both lateral ends thereof to form two sides which have inside teeth, an engaging block having external teeth is additionally provided so that it can be forcedly pressed into the space formed by the two sides with its external teeth matching with the inside teeth of these sides, and hence the prongs of the contacting pieces can extend through the conductors to quickly complete mounting of the conductors in the lamp socket set.

The present invention will be apparent in its objects, characteristics and functions after reading the detailed description of the preferred embodiment thereof in reference to the accompanying drawings.

DETAILED DESCRIPTION OF THE PREFERRED EMBODIMENT

Figure 1:
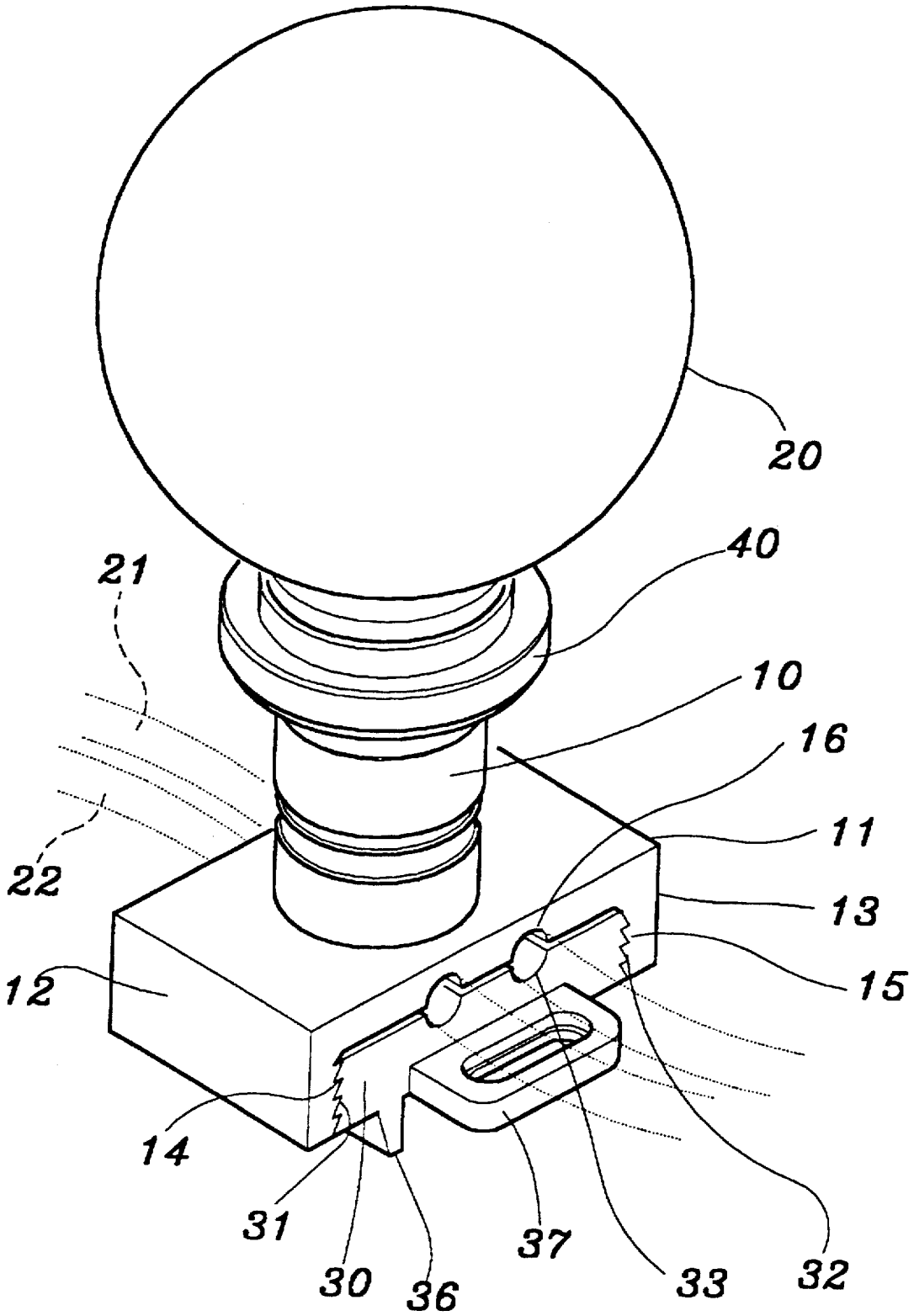
FIG. 1 is a perspective view of an embodiment of the present invention.
Figure 2:
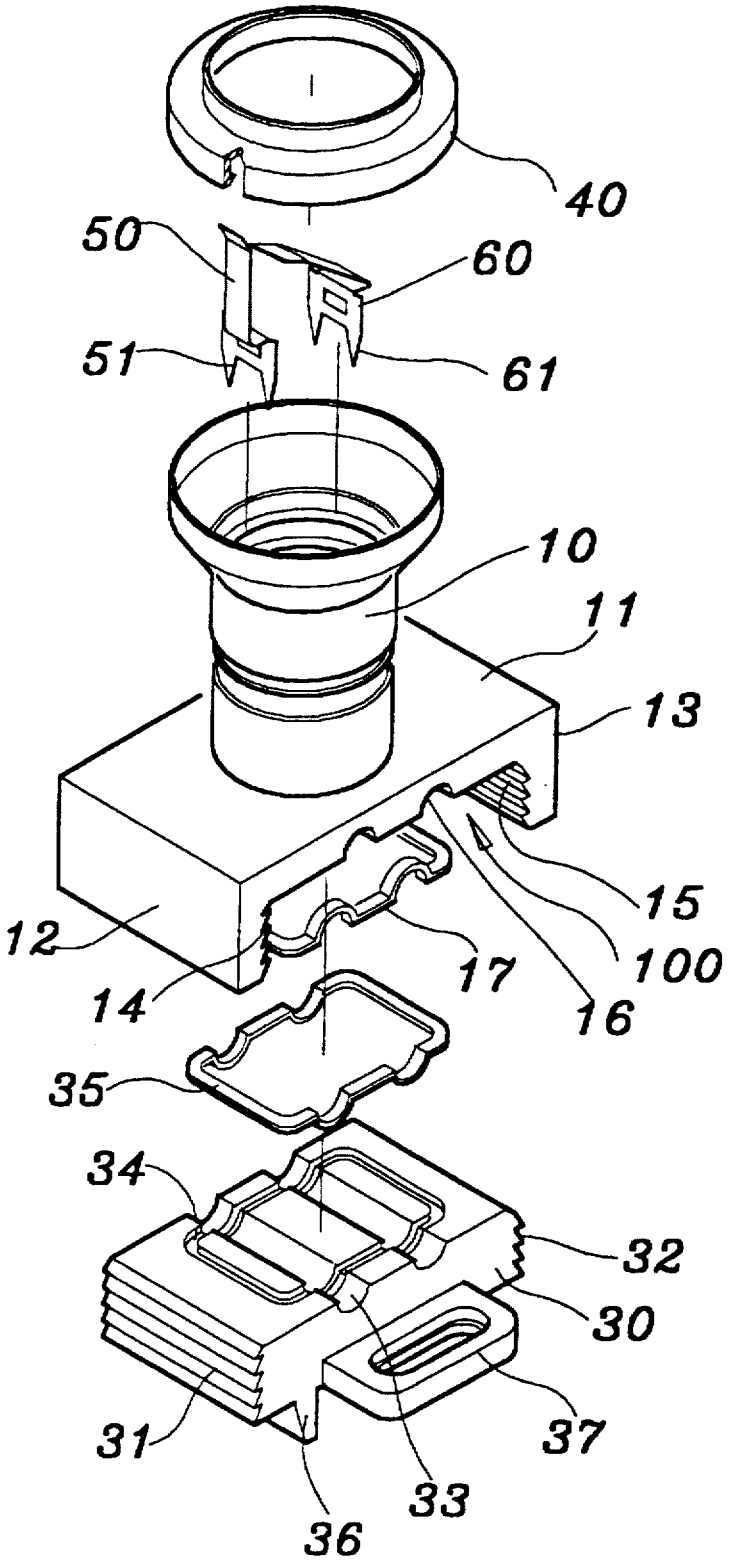
FIG. 2 is an analytic perspective view of the elements composing the embodiment of the present invention shown in FIG. 1.

Referring to FIG. 1 and 2 of the drawings, the present invention includes generally a lamp socket 10 made of plastic and provided for mounting of a lamp bulb 20, the lamp socket 10 can receive an engaging block 30 which can pierce a couple of conductors 21, 22. A leak-proof gasket 40 made of elastomer is provided on the external surface of the lamp socket 10.

Figure 3:
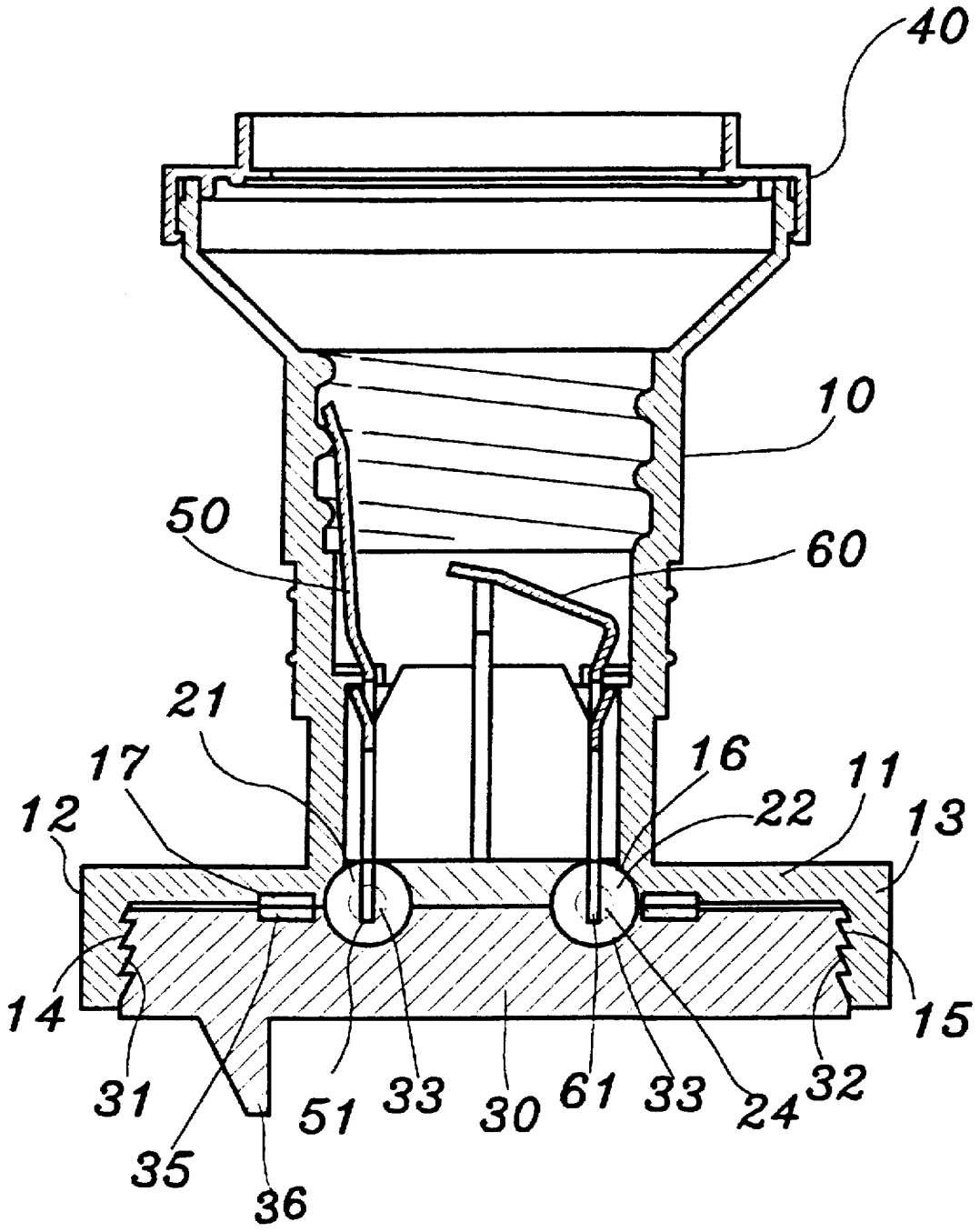
FIG. 3 is a sectional view taken after assembling of the elements in FIG. 2.

Referring to FIG. 2 and 3 of the drawings, the lamp socket 10 is provided internally with two contacting pieces 50, 60 which connect respectively the periphery of a metallic contact annulus on the tailing end of the lamp bulb 20 and the central end tip of the lamp bulb 20 when the latter is screwed in the socket 10. The contacting pieces 50, 60 are provided with down directing prongs 51, 61.

A receiving seat 11 of suitable area is provided on the bottom end of the lamp socket 10, the receiving seat 11 has a receiving space 100 defined by bending down of both the lateral ends forming two sides 12, 13 of the lamp socket 10 which sides 12, 13 have inside teeth 14, 15. Two recesses 16 with the distance therebetween longer than the diameter of the lamp socket 10 are provided on the top surface of the receiving space 100 and under the lamp socket 10 for receiving the conductors 21, 22, and also a leak-proof gasket 17 is provided here for the recesses 16.

The engaging block 30 made of plastic conforming in size with the receiving space 100 is provided with external lateral teeth 31, 32 corresponding in position to the above mentioned inside teeth 14, 15, and also is provided on its top surface which is opposite to the top surface of the receiving space 100 with two recesses 33 for press contacting the conductors 21, 22, a shallow groove 34 conforming in shape with the leak-proof gasket 17 is provided for receiving a leak-proof gasket 35. In the preferred embodiment shown in the drawings, the engaging block 30 is provided with a protrusion 36 on the bottom thereof to be grasped with a hand, and is provided with a pulling handle 37 on the front side thereof.

The engaging block 30 stated above as shown in FIG. 3 has its external teeth 31, 32 matched with and pressed forcedly by the nature of the plastic material of themselves to be in engagement with the the inside teeth 14, 15 of the receiving seat 11, and presses the conductors 21, 22 placed in the recesses 16 and also in the recesses 33, when the whole engaging block 30 is pressed to get to the assembled position as shown in this drawing, the down directing prongs 51, 61 provided on the contacting pieces 50, 60 will be extended through the conductors 21, 22 and clamp fixedly the same. So that the contacting pieces 50, 60 are connected with the metallic core wires 23, 24 of the conductors 21, 22 respectively.

Figure 4:
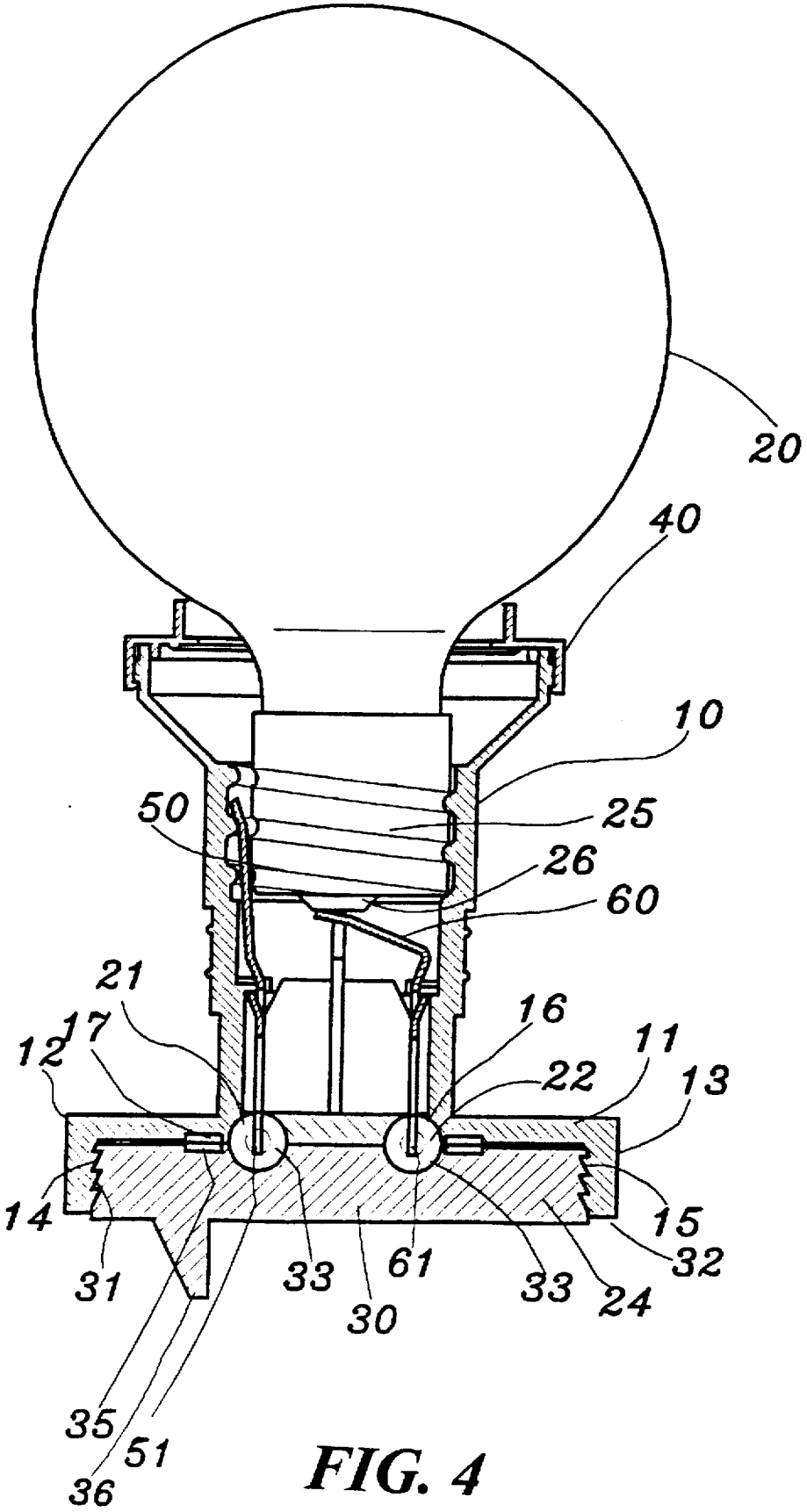
FIG. 4 is a schematic sectional view taken from FIG. 1.

As shown in FIG. 4, when the lamp socket 10 and the conductors 21, 22 are connected in the way as stataed above; and when the bulb 20 is screwed in the lamp socket 10, the external peripheral surface of the end metallic contact annulus 25 contacts the contacting piece 50, while the bottom center 26 thereof contacts the contacting piece 60, by the fact that the down directing prongs 51, 61 on the contacting piece 50, 60 has been extended throug the conductors 21, 22, so that current can be transmitted for lightening. Moreover, the peripheral insulation cover of the conductors 21, 22 are made of plastic elastomer, when the engaging block 30 is forcedly pressed in, the recovery force created by the pressed conductors 21, 22 is exerted in a countrary direction on the mutually engaged teeth, the engaging structure thus is firmer against sliding thereof.

Figure 5:
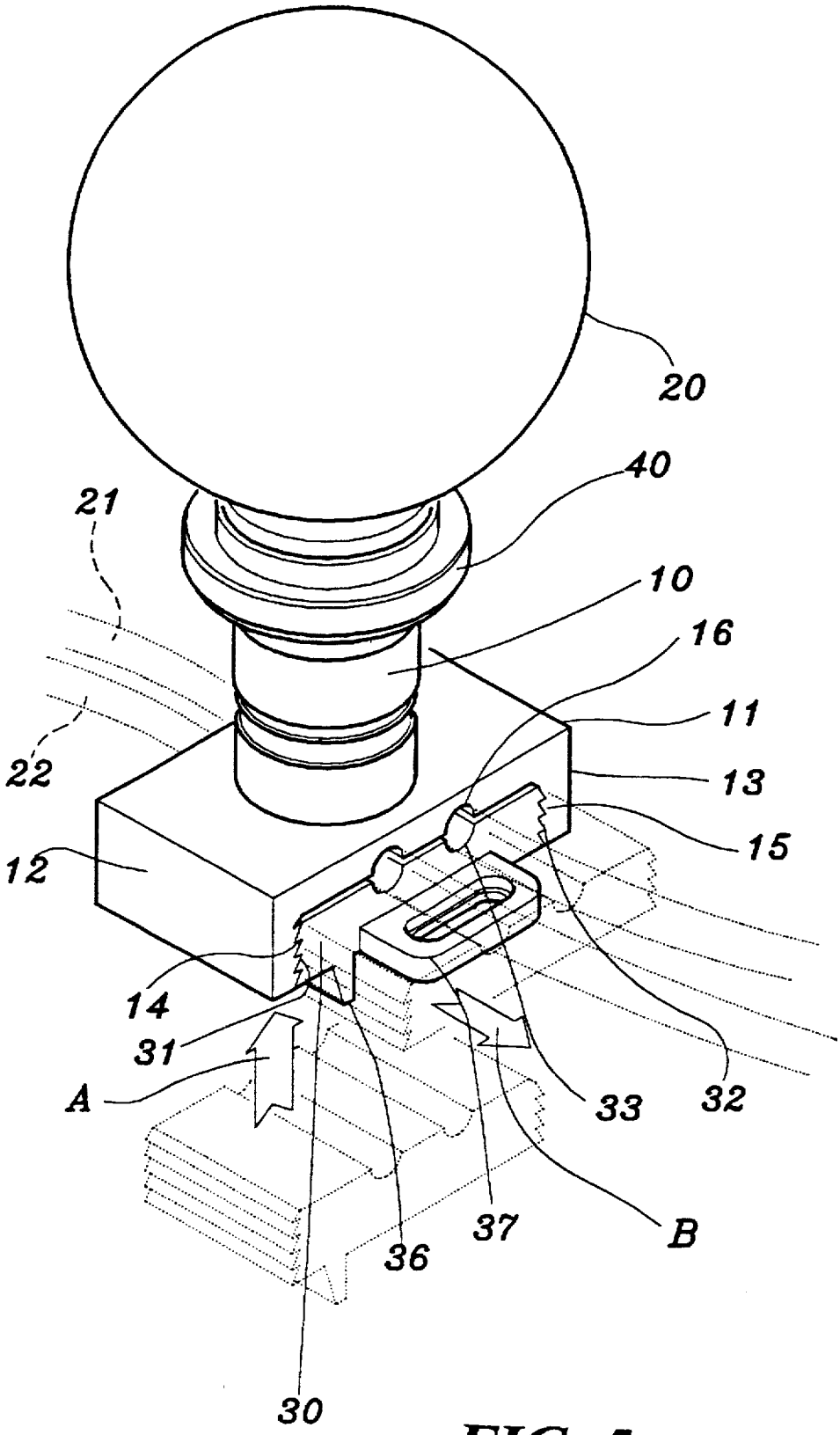
FIG. 5 is a schematic view showing assembling of an engaging block of the present invention.

Referring to FIG. 5, the whole engaging block 30, in addition to being pressed vertically along the arrow A to extend through the conductors 21, 22, can also be pulled away from the receiving seat 11 by pulling the pulling handle 37 along the arrow B in the drawing, the whole lamp bulb 20 and the lamp socket 10 can thereby be removed from the conductors 21, 22.

When in assembling for mounting the conductors 21, 22, it needs only to press the engaging block 30 vertically, piercing connection of the lamp socket 10 with the conductors 21, 22 can be fast and firmly completed. This not only is better in assembling than the conventional structure, but also is faster in assembling and thus is suitable for mass production. The piercing connection on the lamp socket 10 can allow the engaging block 30 to be drawn and separated from the conductors 21, 22 with smaller force, besides, the whole appearance or space style of the present invention is obviously novel.

Having now particularly described and ascertained the technical structure of my invention-with practicability and improveness and in what manner the same is to be performed, what I claim will be declared in the claims followed.

What is claimed is:

1. A lamp socket set in which the conductors are press connected, including on the top thereof a lamp socket provided for mounting of a lamp bulb, and including an engaging block provided on the bottom of said lamp socket, wherein, two contacting pieces are provided internally of said lamp socket to connect respectively the periphery of a metallic contact annulus on the tailing end of and the central end tip of said lamp bulb, two down directing prongs are provided on said contacting pieces;

a receiving seat of suitable area is provided on the bottom end of said lamp socket, said receiving seat has a receiving space defined by bending down of both the lateral ends of said receiving seat to form two sides having inside teeth, a plurality of recesses are provided on the top surface of said receiving space for receiving conductors therein;

and said engaging block conforming in size with said receiving space is provided having external lateral teeth corresponding in position to said inside teeth, and also is provided on its top surface which is opposite to the top surface of said receiving space with other recesses for press contacting said conductors;

said engaging block is pressed vertically onto said receiving seat of said lamp socket set to render said down directing prongs on said contacting pieces to be extended through said conductors.

2. A lamp socket in which the conductors are press connected as claimed in claim 1, wherein, said engaging block is provided with a protrusion on the bottom thereof to be grasped with a hand.

3. A lamp socket in which the conductors are press connected as claimed in claim 1, wherein, said engaging block is provided with a pulling handle on the front side thereof.

4. A lamp socket in which the conductors are press connected as claimed in claim 1, wherein, said engaging block is provided with a protrusion on the bottom thereof and with a pulling handle on the front side thereof.

5. A lamp socket in which the conductors are press connected as claimed in claim 1, wherein, a shallow groove is provided at the position where said recesses on the top surface of said receiving space are located and where said other recesses are located on the top surface of said engaging block for press contacting said conductors, for receiving a leak-proof gasket conformed therewith in shape.

* * * * *